US011661569B2

(12) United States Patent
Haetzelt et al.

(10) Patent No.: US 11,661,569 B2
(45) Date of Patent: May 30, 2023

(54) LIQUID DETERGENT COMPOSITION COMPRISING SUSPENDED SOLID PARTICLES

(71) Applicant: Henkel AG & Co. KGaA, Duesseldorf (DE)

(72) Inventors: Andre Haetzelt, Eimeldingen (DE); Andreas Bauer, Kaarst (DE); Noelle Wrubbel, Duesseldorf (DE); Maren Menz, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 159 days.

(21) Appl. No.: 16/842,825

(22) Filed: Apr. 8, 2020

(65) Prior Publication Data

US 2020/0325419 A1 Oct. 15, 2020

(30) Foreign Application Priority Data

Apr. 10, 2019 (EP) ..... 19168467

(51) Int. Cl.

| | |
|---|---|
| ***C11D 1/00*** | (2006.01) |
| ***C11D 3/37*** | (2006.01) |
| ***C11D 3/38*** | (2006.01) |
| ***C11D 3/50*** | (2006.01) |
| ***C11D 3/39*** | (2006.01) |
| ***C11D 1/08*** | (2006.01) |
| ***C11D 1/14*** | (2006.01) |
| ***C11D 1/34*** | (2006.01) |
| ***C11D 3/22*** | (2006.01) |
| ***C11D 3/386*** | (2006.01) |
| ***C11D 11/00*** | (2006.01) |
| ***C11D 17/00*** | (2006.01) |

(52) U.S. Cl.

CPC ..... *C11D 3/3947* (2013.01); *C11D 1/08* (2013.01); *C11D 1/143* (2013.01); *C11D 1/342* (2013.01); *C11D 3/222* (2013.01); *C11D 3/3726* (2013.01); *C11D 3/3757* (2013.01); *C11D 3/386* (2013.01); *C11D 3/505* (2013.01); *C11D 11/0017* (2013.01); *C11D 17/0039* (2013.01)

(58) Field of Classification Search

CPC ..... C11D 1/00; C11D 3/222; C11D 3/3726; C11D 3/3757; C11D 3/38; C11D 3/50; C11D 3/505; C11D 17/0013; C11D 17/0026; C11D 17/0039

See application file for complete search history.

(56) References Cited

U.S. PATENT DOCUMENTS

| | | | | |
|---|---|---|---|---|
| 6,077,816 | A | 6/2000 | Puvvada et al. | |
| 6,258,771 | B1 | 7/2001 | Hsu et al. | |
| 7,897,557 | B2 | 3/2011 | Schmiedel et al. | |
| 2005/0203213 | A1* | 9/2005 | Pommiers | C11D 3/225 523/210 |

FOREIGN PATENT DOCUMENTS

| | | | |
|---|---|---|---|
| WO | 2006116099 | A1 | 11/2006 |
| WO | 2009101545 | A1 | 8/2009 |
| WO | 2010048154 | A2 | 4/2010 |
| WO | 2010119022 | A1 | 10/2010 |
| WO | 2016185202 | A1 | 11/2016 |
| WO | 2016200761 | A2 | 12/2016 |
| WO | 2018215351 | A1 | 11/2018 |

OTHER PUBLICATIONS

Extended European search report issued for EP application No. 19168467.9 dated Sep. 27, 2019, 8 pages, (for information purpose only).

* cited by examiner

*Primary Examiner* — Brian P Mruk

(74) *Attorney, Agent, or Firm* — Viering Jentschura & Partners mBB

(57) ABSTRACT

A liquid detergent composition may have a continuous liquid phase and solid particles dispersed in the continuous phase. The continuous phase may be transparent or translucent. The solid particles may be made of a polymeric matrix material, have a diameter ranging from about 0.8 to about 8 mm, and may include a plurality of microcapsules. The plurality of microcapsules may be dispersed in the polymeric matrix material. The microcapsules may have a diameter ranging from about 4 to about 70 70 μm. Use of and methods of use of such a liquid composition are also described.

20 Claims, No Drawings

LIQUID DETERGENT COMPOSITION COMPRISING SUSPENDED SOLID PARTICLES

CROSS-REFERENCE TO RELATED APPLICATION

This Patent Application claims priority from European Patent Application No. EP 19168467.9 filed on Apr. 10, 2019, the entire disclosure of which is incorporated herein by reference.

TECHNICAL FIELD

The present disclosure relates to a liquid detergent composition comprising a continuous liquid phase that is transparent or translucent; and solid particles made of a polymeric matrix material that are dispersed in the continuous liquid phase and comprise a plurality of microcapsules. The present disclosure also describes uses of and methods of use of such a liquid composition.

BACKGROUND

Liquid detergents comprising microcapsules are very appealing to consumers. The inclusion of microcapsules in liquid detergents is desirable not only for aesthetic reasons but also for functional reasons such as isolation of incompatible ingredients, controlled and/or delayed release, etc. Ideally, the microcapsules are suspended in the liquid detergent and only dissolve/disintegrate in-use.

Since consumers generally desire a clean and fresh odor whenever they open the package and smell the product, as well as at later points in their laundering experience such as a clean and fresh odor in the laundry room, and on laundered clothing, perfume microcapsules have been used in consumer products to improve fragrance deposition, retention and longevity. Longevity of the scent performance is particularly desirable and typically attained by using fragrance microcapsules.

One problem encountered with the production of liquid detergents comprising encapsulated actives is that the distribution of the encapsulated actives within the liquid matrix needs to be controlled so that the encapsulated actives do not overly float, sink or otherwise gravitate during processing, when packaged for later processing with other ingredients, or when in a packaged consumer product. In order to properly disperse and suspend the encapsulated actives with the liquid matrix, structuring agents can be introduced into the composition. There are number of known compounds which can provide structuring benefits, including but not limited to polymers and gums.

Another problem commonly encountered when formulating such microcapsules into liquid compositions is that the consumers show a clear preference for transparent or translucent formulations. Including microcapsules, in particular when suspended in the liquid phase, causes turbidity in clear liquid formulations due to light scattering at the particles. This is a general problem if the microcapsules are larger than the wavelength of the incident light.

It is an object to provide a liquid detergent composition that comprises microcapsules suspended therein while retaining its transparency or translucency.

SUMMARY

It has been found that this problem can be overcome by incorporating the microcapsules in larger visible beads that dissolve during the washing process and release the microcapsules which then in turn generate the desired effect on the laundered textiles.

In a first aspect, a liquid detergent composition may include:

(a) a continuous liquid phase that is transparent or translucent; and (b) solid particles, wherein said particles (b1) are made of a polymeric matrix material;

(b2) are dispersed in the continuous liquid phase;

(b3) have a diameter in the range of about 0.8 to about 8 mm, such as 1.0 to 2.5 mm; and (b4) comprise a plurality of microcapsules with a diameter in the range of from about 4 to about 70 μm dispersed in the polymeric matrix material.

In another aspect, the use of such compositions for laundering applications, in particular for laundering of textiles is also described.

In a still further aspect, a method for cleaning textiles comprising contacting the textiles with the liquid detergent composition is also described.

DETAILED DESCRIPTION

Wherever percentage values are given herein in relation to the inventive compositions, these are % by weight in relation to the total composition, except explicitly stated otherwise. Additionally, all amounts given herein in relation to at least one component relate to the total content of said component, unless explicitly indicated otherwise. This means that such amounts given in relation to, for example, "at least one nonionic surfactant" relate to the total amount of all nonionic surfactants in the composition.

"At least one", as used herein, relates to one or more, for example, 1, 2, 3, 4, 5, 6, 7, 8, 9 or more. In connection with components of the compositions described herein, this does not relate to the total amount of molecules but to the type of the component. "At least one nonionic surfactant" thus means that the compositions contain one or more different types of nonionic surfactants. If amounts are indicated, they relate to the total amount of the respective type of component, as described above.

When reference is made herein to water content, the water content is the one that can be determined by use of Karl Fischer titration (Angewandte Chemie 1935, 48, 394-396; ISBN 3-540-12846-8 Eugen Scholz).

The compositions may be or include liquid detergent compositions.

The term "liquid", as use herein, relates to compositions that are liquid at standard conditions, i.e. 20° C. and 1013 mbar. The term includes non-Newtonian fluids that have a yield point as well as gels and pastes. In non-limiting embodiments, the liquid compositions are pourable.

"Detergent composition", as used herein, covers all types of detergents and includes laundry detergents for textiles as well as compositions that are used as pre-wash or post-wash compositions during laundering of textiles, i.e. formulations that are used for treating the textile prior to or after the actual laundering step. Such formulations include stain removers, fabric softeners and fabric conditioners, without being limited thereto.

The detergent compositions are liquid and can be in any form or dosage unit known for such compositions in the field. These include gels and pouches, either in bulk format or in unit dose form. The liquid detergent compositions are liquid laundry detergents, for example liquid laundry detergents, including universal liquid laundry detergents and those for colored textiles.

The inventive compositions are transparent or translucent, with these terms being used interchangeably herein. If a composition has a transmission of at least 20% in the spectral range of 380 to 780 nm relative to a reference standard, it is considered "transparent". Transmission values of at least 50%, such as at least 70%, may be useful for the composition.

The transparency can be determined using different methods. Commonly, the nephelometric turbidity unit (NTU) is used as a means to determine transparency. It is a unit for turbidity measurements in water treatment applications and describes the turbidity as measured with a calibrated nephelometer. High NTU values indicate turbid compositions, while low values are obtained for clear, transparent compositions.

The transparency can, for example, be measured using a turbidimeter of the type HACH Turbidimeter 2100Q (Hach Company, Loveland, Colo. (USA)) using the calibrating substances StablCal Solution HACH (20 NTU), StablCal Solution HACH (100 NTU) and StablCal Solution HACH (800 NTU), all commercially available from the Hach Company. The measurement is conducted in a 10 ml closed cuvette at 20° C. At an NTU value (at 20° C.) of 60 or more, the compositions are visibly turbid (for the naked eye). The compositions may have an NTU value (at 20° C.) of no more than 120, such as 110 or less, alternatively 100 or less, or 80 or less, or 60 or less.

According to a non-limiting embodiment, the transparency was determined by measuring transmission in the visible spectrum over a wavelength range of 380 to 780 nm at 20° C. For this, a reference sample of water (deionized) is analyzed in a photometer (Specord S 600; AnalytikJena) in a transparent cuvette with a radiation path length (width) of 10 mm. After that the cuvette is filled with the sample composition and the transmission determined again.

According to a non-limiting embodiment, the transparent composition may have a transmission at 20° C. of at least 25%, such as at least 30%, alternatively at least 40%, alternatively at least 50%, or at least 60%, e.g. of 70% or more.

It is understood that while transparent clear compositions may have the above transmission values over the complete range of the measured wavelength spectrum, colored compositions may show such transmission values only in parts of the measured spectrum.

The composition may have a transmission at 20° C. of at least 25%, such as at least 30%, alternatively at least 40%, alternatively at least 50%, or at least 60%, e.g. of 70% or more and an NTU value (at 20° C.) of no more than 120, such as 110 or less, alternatively 100 or less, or 80 or less, e.g. 60 or less.

It is understood that when the transparency or translucency of the inventive compositions is described herein, said features relate to the continuous liquid phase of the inventive compositions, i.e. without the solid beads. The respective transparent liquid phases are then combined with the solid beads as described herein.

"Solid", as used herein, in particular in relation to the particles, refers to a material that is solid at standard conditions, i.e. at 20° C. and 1013 mbar. It does however not exclude that such solid materials melt or dissolve at higher temperatures, such as those that occur during the laundering of textiles in an automatic washing machine.

The solid particles dispersed in the continuous liquid phase are made of a polymeric matrix material. This means that the base material of said particles is a polymeric material. When the particles are described to consist of such a polymeric material, this means that the matrix material of the particles consists of said material. It is however understood that particles can comprise further components, such as the microcapsules as well as further compounds or agents.

The solid particles may not have a core-shell morphology. In accordance therewith, the solid particles may not be hollow or exhibit a material gradient (of two solid materials) across their diameter, but are essentially homogeneous with respect to their mass/material distribution.

The solid particles may be essentially spherical in shape although other shapes are also possible, such as hemispheres, drop-shapes, oval shapes, and polyhedral forms. The shapes may be compact shapes, i.e. the aspect ratio of length, width and height is about 0.8 to 1.2, such as about 1.

"About", as used herein in relation to numerical values, means the referenced value ±10%, such as ±5%. "About 1" thus means 0.9 to 1.1, or 0.95 to 1.05.

The solid particles may have a diameter in the range of about 0.8 to about 8 mm, such as 1.0 to 2.5 mm. If the particles are not spherical, the equivalent diameter is used, i.e. the diameter of a sphere that has the same volume as the particle. About 90% of the particles may be present in the compositions have a diameter in the given range, i.e. only 10% of the particles present have smaller or greater dimensions. Alternatively, 95, 97, 98 or 99 or 100% of the particles may have diameters falling in the given range. The small percentage of particles that do not fall within the given range, if present at all, may have diameters that are within ±50%, such as ±30% of the lower and upper limits given for the other particles. The particle size distribution may be as narrow as possible, i.e. the particles have essentially all the same size. About 90% of the particles may be within a diameter size band of about 1 mm. In terms of D values (mass based), the solid particles may have a d10 value of 0.5 mm, such as 1 mm, and/or a d50 value of 1.0 to 4.0, alternatively 1.0 to 2.0 mm, and/or a d90 value of 5.0 to 8.0 mm, or about 2.5 mm. In various embodiments, the d10 value may be 0.5 mm, the d50 value may be 1.0 to 4.0 mm and the d90 value may be 5.0 to 8.0 mm. In various other embodiments, the d10 value may be 1.0 mm, the d50 value 1.0 to 2.0 mm, and the d90 value 2.5 mm.

The particle size of the solid particles can be determined using any suitable method, including optical measurements, sieving methods and the like. All of these are well known to those skilled in the art.

The solid particles may be made of a polymeric material that is water-soluble or water-dispersible, in particular under specified conditions, such as those described below. "Water-soluble" and "water-dispersible", as used herein, mean that a given material under specified conditions has a solubility of at least 1 g/100 mL water or is dispersible, optionally under agitation/stirring, in water, respectively. This means that the material dissolves or is dispersed in the suds during a laundering operation, for example in an automatic washing machine. The particles do not dissolve or disperse in the inventive composition, this being controlled by either the composition containing low amounts of water, salts or stabilizers and/or alternatively the water-solubility or water-dispersibility being only noticeable or triggered at any one or more of (i) the elevated temperatures, (ii) the dilution in water, and (iii) the mechanical forces the particles are subjected to in the washing machine that occur during the laundering operation.

The material of the solid particles can, in various embodiments, be chosen from various polymers and gums, including but not limited to polyethylene glycol, alginate, carrageen, gelatin, agar agar, and gellan as well as combinations thereof. Methods for forming particles of these materials are known in the art, for example in various food-related applications. Usually, the methods involve heating a solution containing said polymeric material and cooling shapes, such as droplets, formed from the heated liquid material that solidifies upon cooling. Common methods include dropletizing in which droplets of the heated liquid material are dropped into a cooling bath in which they solidify in an essentially spherical shape. In the case of alginate, solidification can be achieved by dripping an alginate solution (for example 0.5 wt.-% in water) into a solution containing calcium ions, for example containing calcium acetate at a concentration of 5 wt.-%. Accordingly, methods in which droplets of a solution or melt of the particle material are contacted with a solution with an agent that causes solidification of the particle material are similarly contemplated.

As described below, the microcapsules can be entrapped in the matrix material by combining the microcapsules with the liquid matrix material prior to solidification.

The solid particles comprise a plurality of microcapsules homogeneously dispersed within the matrix material. The number of microcapsules per particle can typically range from about 200 to about 10,000,000, such as between 500 and 200,000.

The concentration of the solid particles in the liquid detergent may range from about 0.05 wt.-% to about 5 wt.-%, alternatively 0.1 to 0.35 wt.-% relative to the total weight of the liquid detergent. In various embodiments, this means that there are between 20 and 200 solid particles per 100 mL liquid detergent composition, such as 40 to 180, alternatively 50 to 150, or 55 to 120 or 60 to 110, e.g. about 70 to about 100.

The solid particles are stably suspended in the liquid detergent composition. In general, "stably suspended/dispersed" as used herein means that under normal storage and use conditions the particles stay in the formulation without substantial sedimentation or floating, such as over a time period of at least 3, or about 6 months. For this, the density of the particles or composition may be adjusted such that the particles are free-floating within the composition, i.e. do neither sediment nor float on the surface. Alternatively or additionally, the liquid composition may be a structured liquid detergent composition, optionally having a yield point. In various embodiments, the compositions may have a yield point.

The microcapsules are dispersed in the matrix material of the solid particles and are of a size that is compatible with the size of the solid particles. Typical diameters are in the range of from about 4 to about 70 μm, such as 5 to 50 μm. The microcapsules are essential of spherical shape and may have a core shell morphology, with the benefit agent encapsulated within a shell material and forming the core or part of the core.

The term "microcapsule", as used herein, generally refers to capsules having a core-shell morphology in the micrometer scale, which have a capsule shell, which fully surrounds a core. "Fully surrounds", as used herein with respect to the microcapsules, means that the core is completely surrounded by the shell, i.e. the core is not embedded in a matrix such that it is exposed to the surroundings in certain areas. The capsule shell may be such that the release of the contents is controlled, i.e. the content is not released in an uncontrolled manner, i.e. independent of a release stimulus. For this reason, the capsule shell is substantially impermeable to the encapsulated content. By "substantially impermeable" as used in this context, it is meant that the contents of the capsule or single ingredients of the encapsulated material cannot spontaneously penetrate the shell, but the release occurs by breaking the capsule or optionally occurs over extended periods of time via a diffusion process. The encapsulated core can be solid, liquid and/or gas, but may be solid and/or liquid.

The microcapsules may be friable microcapsules, moisture-activated microcapsules, heat-activated microcapsules, or combinations thereof, with friable microcapsules being possible. Any of the afore-mentioned microcapsules may additionally show slow release of the encapsulated agent by diffusion processes.

If the microcapsules are not perfectly spherical, the equivalent diameter is used, i.e. the diameter of a sphere that has the same volume as the microcapsule. About 90% of the microcapsules present in the compositions may have a diameter in the given range, only 10% of the microcapsules present having smaller or greater dimensions. 95, 97, 98 or 99% of the microcapsules may have diameters falling in the given range. The particle size distribution of the microcapsules may be as narrow as possible, i.e. the microcapsules have essentially all the same size. About 90% of the microcapsules may be within a diameter size band of about 10 μm. In terms of D values (mass based), the microcapsules have a d10 value of 1 to 2 μm, such as 2 mm, and/or a d50 value of 5.0 to 40.0, such as 10.0 to 25.0 μm, and/or a d90 value of 70 to 100 μm, alternatively about 50 μm.

The particle size of the microcapsules can be determined using any suitable method, including microscopy, laser diffraction and the like. All of these are well known to those skilled in the art.

The shell material of the microcapsules is typically a polymeric material and can be selected from, without limitation, high-molecular compounds of animal or plant origin such as protein compounds (gelatin, albumin, casein), cellulose derivatives (methyl cellulose, ethyl cellulose, cellulose acetate, cellulose nitrate, carboxymethyl cellulose), and in particular synthetic polymers. Suitable synthetic polymers for the shell include, without limitation, polyamides, polyolefins, polyesters, polyurethanes, epoxy resins, silicone resins, and condensation products of carbonyl and NH groups-containing compounds. More specifically, the shell material can for example be selected from polyacrylates; polyethylene; polyamides; polystyrenes; polyisoprenes; polycarbonates; polyesters; polyureas; polyurethanes; polyolefins; polysaccharides; epoxy resins; vinyl polymers; urea crosslinked with formaldehyde or glutaraldehyde; melamine cross-linked with formaldehyde; gelatin-polyphosphate coacervates optionally cross-linked with glutaraldehyde; gelatin-gum arabic coacervates; silicone resins; unreacted polyamines with polyisocyanates; acrylate monomers polymerized by means of free radical polymerization; silk; wool; gelatin; cellulose; proteins; and blends and copolymers of the foregoing. In a non-limiting embodiment, the shell material may be or include polyacrylates, polyethylene, polyamides, polystyrenes, polyisoprenes, polycarbonates, polyesters, polyureas, polyurethanes, polyolefins, epoxy resins, vinyl polymers, and urea and/or melamine cross-linked with formaldehyde or glutaraldehyde.

To prepare the microcapsules, known microencapsulation techniques can be used.

In various embodiments, the concentration of the microcapsules in the solid particles ranges from about 5 wt.-% to about 75 wt.-%, such as from about 10 wt.-% to about 70 wt.-%, alternatively from about 15 to about 50 wt.-%, or from about 15 to about 25 wt.-%, relative to the total weight of the particles.

The microcapsules may be entrapped in the solid beads and that the content of free microcapsules in the liquid phase, i.e. microcapsules not entrapped in the solid particles, is below 0.1 wt.-%. This helps to retain transparency/translucency of the composition.

The benefit agent encapsulated in the microcapsules may include a fragrance or perfume composition. As fragrances or perfumes or perfume oils all substances and mixtures thereof known as such or known for such purpose can be used. As used herein, the terms "fragrance (s)", "fragrance" and "perfume oil (s)" are used synonymously. These terms particularly relate to those substances or mixtures thereof that are perceived as odors by humans and animals, especially those perceived by humans as fragrances. Perfume oils or fragrances may include individual perfume compounds and may, for example, be synthetic products of the ester, ether, aldehyde, ketone, alcohol and hydrocarbon type.

Perfume compounds of the aldehyde type include, without limitation, adoxal (2,6,10-trimethyl-9-undecenal), anisic aldehyde (4-methoxybenzaldehyde), cymal (3-(4-isopropylphenyl)-2-methylpropanal), ethyl vanillin, florhydral (3-(3-isopropylphenyl) butanal), helional (3-(3,4-methylenedioxyphenyl)-2-methylpropanal), heliotropin, hydroxycitronellal, lauric aldehyde, lyral (3- and 4-(4-hydroxy-4-methylpentyl)-3-cyclohexene-1-carboxaldehyde), methyl nonylacetaldehyde, filial (3-(4-tert-butylphenyl)-2-methylpropanal), phenylacetaldehyde, undecylenic aldehyde, vanillin, 2,6,10-trimethyl-9-undecenal, 3-dodecen-1-al, alpha-n-amyl cinnamic aldehyde, melonal (2,6-dimethyl-5-heptenal), 2,4-dimethyl-3-cyclohexene-1-carboxaldehyde (triplal), 4-methoxybenzaldehyde, benzaldehyde, 3-(4-tert-butylphenyl)-propanal, 2-ethyl-3-(para-methoxyphenyl)propanal, 2-methyl-4-(2,6,6-trimethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzylaldehyd, 1,2,3,4,5,6,7,8-octahydro-8,8-dimethyl-2-naphthaldehyde, 2,4-dimethyl-3-cyclohexene carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indene carboxaldehyde, 3-ethoxy-4-hydroxybenzaldehyde, para-ethyl-alpha,alpha-dimethylhydro cinnamic aldehyde, alpha-methyl-3,4-(methylenedioxy)-hydro cinnamic aldehyde, 3,4-methylenedioxybenzaldehyde, alpha-n-hexyl cinnamic aldehyde, m-cymen-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cylohexene-1-carboxaldehyde, 7-ethoxy-3,7-dimethyloctane-1-al, 2-methyl undecanal, 2-ethyldecanal, 1-Nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanindane-1-or-2-carboxaldehyde, 3,7-Dimethyloctan-1-al, 1-undecanal, 10-undecen-1-al, 4-hydroxy-3-m ethoxybenzaldehyde, 1-methyl-3-(4-methylpentyl)-3-cyclohexenecarboxaldehyde, 7-hydroxy-3,7-dimethyl-octanal, trans-4-decenal, 2,6-nonadienal, para-tolylacetaldehyde, 4-methylphenylacetaldehyde, 2-methyl-4-(2,6,6-trimethyl-1-cyclohexene-1-yl)-2-butenal, ortho-methoxycinnamaldehyde, 3,5,6-trimethyl-3-cyclohexene-carboxaldehyde, 3,7-dimethyl-2-methylene-6-octenal, phenoxyacetaldehyde, 5,9-dimethyl-4,8-decadienal, 6,10-dimethyl-3-oxa-5,9-undecadien-1-al, hexahydro-4,7-methanindane-1-carboxaldehyde, 2-methyl octanal, alpha-methyl-4-(1-methylethyl) benzene acetaldehyde, 6,6-dimethyl-2-norpinen-2-propionaldehyde, para-ethylphenoxyacetaldehyde, 2-methyl-3-phenyl-2-propen-1-al, 3,5,5-trimethylhexanal, hexahydro-8,8-dimethyl-2-naphthaldehyd, 3-propyl-bicyclo[2.2.1]hept-5-ene-2-carbaldehyde, 9-decenal, 3-methyl-5-phenyl-1-pentanal, ethylnonylacetaldehyde, hexanal and trans-2-hexenal.

Perfume compounds of the ketone type include, without limitation, methyl-beta-naphthyl ketone, musk indanone (1,2,3,5,6,7-hexahydro-1,1,2,3,3-pentamethyl-4H-inden-4-one), Tonalid (6-acetyl-1,1,2,4,4,7-hexamethyltetralin), alpha-damascone, beta-damascone, delta-damascone, iso-damascone, damascenone, ethyldihydrojasmonat, menthone, carvone, camphor, koavone (3,4,5,6,6-Pentamethyl-hept-3-en-2-one), fenchone, alpha-ionone, beta-ionone, gamma-methyl ionone, Fleuramon (2-heptylcyclopentanon), dihydrojasmone, cis-jasmone, iso-e-super (1-(1,2,3,4,5,6,7,8-octahydro-2,3,8,8-tetramethyl-2-naphthalenyl) ethane-1-one (and isomers)), methylcedrenylketone, acetophenone, methyl acetophenone, para-methoxy acetophenone, methyl-beta-naphtylketone, benzylacetone, benzophenone, para-hydroxyphenylbutanone, celery ketone (3-methyl-5-propyl-2-cyclohexenone), 6-Isopropyldecahydro-2-naphton, dimethyloctenon, Frescomenthe (2-butan-2-yl-cyclohexane-1-one), 4-(1-ethoxyvinyl)-3,3,5,5-tetramethylcyclohexanone, methyl heptenone, 2-(2-(4-methyl-3-cyclohexene-1-yl)propyl)cyclopentanone, 1-(p-menthene-6 (2)yl)-1-propanone, 4-(4-hydroxy-3-methoxyphenyl)-2-butanone, 2-acetylamino-3,3-dimethylnorbornan, 6,7-dihydro-1,1,2,3,3-pentamethyl-4 (5H)-indanon, 4-Damascol, Dulcinyl (4-(1,3-benzodioxol-5-yl) butan-2-one), Hexalon (1-(2,6,6-trimethyl-2-cyclohexene-1-yl)-1,6-heptadiene-3-one) Isocyclemon E (2-acetonaphthon-1,2,3,4,5,6,7,8-octahydro-2,3,8,8-tetramethyl), methyl nonyl ketone, Methylcyclocitron, methyl lavender ketone, Orivon (4-tert-amyl-cyclohexanone), 4-tert-butylcyclohexanone, Delphon (2-pentyl-cyclopentanone), muscone (CAS 541-91-3), Neobutenone (1-(5,5-dimethyl-1-cyclohexenyl) pent-4-en-1-one), Plicaton (CAS 41724-19-0), veloutone (2,2,5-trimethyl-5-pentylcyclopentane-1-one), 2,4,4,7-tetramethyl-oct-6-en-3-one and Tetrameran (6,10-Dimethylundecene-2-one).

Perfume compounds of the alcohol type include, for example, 10-undecene-1-ol, 2,6-dimethylheptan-2-ol, 2-methyl-butanol, 2-methyl-pentanol, 2-phenoxyethanol, 2-phenylpropanol, 2-tert-butycyclohexanol, 3,5,5-trimethylcyclohexanol, 3-hexanol, 3-methyl-5-phenyl-pentanol, 3-octanol, 3-phenyl-propanol, 4-heptenol, 4-isopropylcyclohexanol, 4-tert-butylcyclohexanol, 6,8-dimethyl-2-nonanol, 6-nonene-1-ol, 9-decen-1-ol, alpha-methylbenzylalcohol, α-terpineol, amyl salicylate, benzyl alcohol, benzyl salicylate, beta-terpineol, butyl salicylate, citronellol, cyclohexylsalicylate, decanol, di-hydromyrcenol, dimethylbenzylcarbinol, dimethylheptanol, dimethyloctanol, ethylsalicylate, ethylvanillin, eugenol, farnesol, geraniol, heptanol, hexylsalicylat, isoborneol, isoeugenol, isopulegol, linalool, menthol, myrtenol, n-hexanol, nerol, nonanol, octanol, p-menthane-7-ol, phenylethyl alcohol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Perfume compounds of the ester type include, without limitation, benzyl acetate, phenoxyethyl isobutyrate, p-tertbutylcyclohexyl acetate, linalyl acetate, dimethyl benzyl (DMBCA), phenylethyl acetate, benzyl acetate, ethyl methyl phenylglycinate, allyl cyclohexyl propionate, styrallylpropionate, benzyl salicylate, cyclohexyl salicylate, floramat, melusate and jasmacyclate.

The ethers include, for example, benzyl ethyl ether and ambroxan. The hydrocarbons mainly include terpenes such as limonene and pinene.

Non-limiting mixtures of different fragrances are used, which together produce a pleasing fragrance note. Such a mixture of fragrances may also be called a perfume or fragrance oil. Such perfume oils may also contain natural fragrance mixtures, as are obtainable from plant sources.

The fragrances of plant origin include essential oils such as *angelica* root oil, anise oil, *arnica* blossom oil, basil oil, bay oil, champaca blossom oil, citrus oil, silver fir oil, noble fir cone oil, elemi oil, *eucalyptus* oil, fennel oil, spruce needle oil, *galbanum* oil, geranium oil, ginger grass oil, guaiac wood oil, gurjun balsam oil, Helichrysum oil, Ho oil, ginger oil, iris oil, jasmin oil, cajeput oil, calamus oil, camomile oil, camphor oil, kanaga oil, cardamom oil, *cassia* oil, pine needle oil, kopaiva balsam oil, coriander oil, spearmint oil, caraway oil, cumin oil, labdanum oil, lavender oil, lemongrass oil, lime blossom oil, lime oil, mandarin oil, melissa oil, mint oil, ambrette seed oil, muskateller oil, myrrh oil, clove oil, neroli oil, niaouli oil, olibanum oil, orange blossom oil, orange peel oil, *origanum* oil, palmarosa oil, patchouli, Peru balsam oil, petitgrain oil, pepper oil, peppermint oil, pimento oil, pine oil, rose oil, rosemary oil, sage oil, sandalwood oil, celery oil, spike oil, star anise oil, turpentine oil, *thuja* oil, thyme oil, *verbena* oil, vetiver oil, juniper berry oil, wormwood oil, wintergreen oil, ylang-ylang oil, hyssop oil, cinnamon oil, cinnamon leaf oil, citronella oil, lemon oil and cypress oil and ambrettolide, ambroxan, alpha amyl cinnamic aldehyde, anethole, anisaldehyde, anisic alcohol, anisole, methyl anthranilate, acetophenone, benzyl acetone, benzaldehyde, ethyl benzoate, benzophenone, benzyl alcohol, benzyl acetate, benzyl benzoate, benzylformate, benzylvalerianate, borneol, bornylacetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptane carboxylic acid methylester, heptaldehyde, hydroquinone dimethyl ether, hydroxycinnamaldehyde, hydroxycinnamic alcohol, indole, irone, isoeugenol, isoeugenol methyl ether, isosafrole, jasmone, camphor, Karvakrol, carvone, p-cresolmethylether, coumarin, p-methoxyacetophenone, methyl-n-amyl ketone, methyl anthranilic acid methylester, p-methylacetophenone, methylchavikol, p-methylquinoline, methyl-beta-naphthyl ketone, methyl-n-nonylacetaldehyde, methyl-n-nonylketone, muskon, beta-naphtholethylether, beta-naphthol methyl ether, nerol, n-nonyl aldehyde, nonyl alcohol, n-octyl aldehyde, p-oxy-acetophenone, Pentadekanolid, beta-phenylethyl alcohol, phenylacetic acid, pulegone, safrole, salicylic acid isoamylester, methyl salicylate, salicylic acid hexylester, salicylic acid cyclohexylester, santalol, Sandelice, skatole, terpineol, thymene, thymol, Troenan, gamma-undelacton, vanillin, veratraldehyde, cinnamaldehyde, cinnamic alcohol, cinnamic acid, ethyl cinnamate, cinnamic acid benzylester, diphenyl oxide, limonene, linalool, linalyl acetate and-propionate, Melusat, menthol, menthone, methyl-n-heptenon, pinene, phenylacetaldehyde, terpinyl acetate, citral, citronellal, and mixtures thereof.

To be perceptible, a fragrance must be volatile; in addition to the nature of the functional groups and the structure of the chemical compound, the molecular weight also plays an important role. Thus, most perfumes have molecular weights up to about 200 Dalton, while molar masses of 300 Dalton and above are rather an exception. Because of the different volatilities of perfumes, the smell of a composite of a plurality of odoriferous perfume or fragrance changes during evaporation, wherein the odor impressions are divided in top note, middle note and body, and base note (end note or dry out). Analogous to the description in international patent publication WO 2016/200761 A2 can top, middle and base notes can be classified by their vapor pressure, using the method described in WO 2016/200761.

Non-limiting usable fragrance compounds of the aldehyde type include hydroxycitronellal (CAS 107-75-5), helional (CAS 1205-17-0), citral (5392-40-5), bourgeonal (18127-01-0), triplal (CAS 27939-60-2), ligustral (CAS 68039-48-5), vertocitral (CAS 68039-49-6), florhydral (CAS 125109-85-5), citronellal (CAS 106-23-0), and citronellyloxyacetaldehyde (CAS 7492-67-3).

Additionally or alternatively to the above, the fragrances described in WO 2016/200761 A2, in particular, the fragrances mentioned in Tables 1, 2 and 3, as well as the modulators listed in Tables 4a and 4b can be used. This publication is incorporated herein by reference in their entirety.

The microcapsules may also include other oils in addition to fragrances. In particular, the microcapsules may also contain active ingredients in oil form, which are suitable for washing, cleaning, care and/or processing purposes, in particular (A) fabric care substances, such as silicone oils, and/or (B) skin care substances, such as, such as vitamin E, natural oils and/or cosmetic oils.

Such embodiments are described in greater detail in international patent publication WO 2018/215351 A1. The microcapsules of the inventive also comprise the microcapsules having an outer shell and encapsulating smaller microcapsules therein that are described in this document. The respective document is thus herein enclosed by reference in its entirety.

The microcapsules may be provided in form of a slurry, i.e. a dispersion of the solid microcapsules in a liquid carrier medium, such as an aqueous or organic solvent. Such slurries are commonly available from various manufacturers and typically comprise between 25 and 75% solids, i.e. microcapsules. These microcapsule slurries can be used for particle formation, as described above, by mixing the slurry with the particle material prior, during or upon particle formation.

In addition to the microcapsules, the solid particles may comprise additional components, for example dispersed in the matrix material. These additional components include free perfume ingredients, such as those described above, and colorants. Also encompassed are scent modulators, such as those mentioned above. These can be present in amounts of up to 25% by weight, relative to the total weight of the particles. The amount of polymeric matrix material in the solid particles is at least 0.1% by weight, such as at least 1% by weight. Depending on the polymeric material, the amount of polymer material in the beads may range between 0.1 and 30 wt. %, alternatively between 0.1 and 10 wt. %, or between 0.1 and 7 wt. %.

In various embodiments, the solid particles and/or the liquid phase can comprise a neat perfume, i.e. a perfume composition not encapsulated in the microcapsules. This perfume composition may differ from the composition encapsulated in the microcapsules. This allows a so-called scent switch in that the scent from the composition is dominated by the neat perfume and perceived different to that of the encapsulated perfume that is released from the washed and dried laundry upon rupture of the microcapsules (in case of friable microcapsules) at a later stage.

The liquid detergent compositions can further comprise common components of detergent compositions, in particular of laundry detergent compositions. These may comprise ingredients that further improve the application or aesthetic properties of the composition. These further ingredients may include, without limitation, one or more substances from the group of detersive surfactants, detergency builders, bleaching agents, bleach activators, bleach catalysts, enzymes, structurants, thickening agents, non-aqueous solvents, pH adjusting agents, free perfumes, fluorescing agents, dyes, hydrotropes, silicone oils, anti-redeposition agents, anti-gray agents, shrinkage preventers, wrinkle protection agents, dye transfer inhibitors, antimicrobial active substances, germicides, fungicides, antioxidants, preservatives, corrosion inhibitors, antistatic agents, bittering agents, ironing adjuvants, proofing and impregnation agents, swelling and anti-slip agents, softening compounds, complexing agents and UV absorbers.

From the above mentioned further ingredients, detersive surfactants, detergency builders, enzymes, non-aqueous solvents, structurants, pH adjusting agents, free perfumes, fluorescing agents, dyes, silicone oils, soil-release polymers, anti-gray agents, dye transfer inhibitors, and preservatives may be included into a liquid detergent composition.

As described above, in various embodiments, the compositions is a structured liquid detergent composition. The composition can be externally or internally structured; however, an external structurant may be used for externally structuring the liquid detergent composition.

Examples of known internal structuring agents include, without limitation, surfactants, electrolytes (which can promote the formation of worm like micellar self-assembly structures). Known external structuring agents include polymers or gums, many of which are known to swell or expand when hydrated to form random dispersion of independent microgel particles. Examples of polymers and gums include: gellan gum, pectine, alginate, arabinogalactan, carrageenan, xanthum gum, guar gum, rhamsan gum, furcellaran gum, carboxymethylcellulose and cellulose. Such structurants are, for example, described in U.S. Pat. Nos. 6,258,771, 6,077,816, U.S. Patent Publ. No. 2005/0203213 and WO 2006/116099.

It has been found that cellulose, as for example described in WO 2009/101545 A1 and WO2010/048154 A2, as particularly suited as an external structurant for the liquid detergent compositions, as it provides for the desired viscosity and rheological properties of the composition, allows to suspend the solid particles and also ensures that transparency/translucency of the composition are retained. Microfibrillated or microfibrous cellulose, for example from bacterial or plant sources, may from bacterial sources.

In various embodiments, the liquid detergent composition therefore comprises an external structurant, for example bacterial cellulose, such as microfibrillated cellulose. In various embodiments, two or more structurants can be used or a structurant, as described herein, can be combined with a thickening agent, such as a polymeric thickener.

The compositions furthermore comprise, in various embodiments, at least one detersive surfactant, such as an anionic and/or nonionic surfactant and/or amphoteric surfactant.

The liquid detergent composition may comprise anionic surfactant at a level of from 3% up to 25% by weight of said composition, such as, at a level of from 4% up to 20% by weight of said composition and, and alternatively, at a level of from 5% up to 15% by weight of said composition.

The anionic surfactant may comprise linear alkylbenzene sulphonate and/or fatty alcohol ether sulfate.

Fatty alcohol ether sulfates are water-soluble salts of the formula $RO(A)_mSO_3M$, in which R is an unsubstituted $C_{10}$-$C_{24}$-alkyl or-hydroxyalkyl radical, such as a $C_{12}$-$C_{20}$-alkyl or-hydroxyalkyl radical, alternatively $C_{12}$-$C_{18}$-alkyl or-hydroxyalkyl radical. A is an ethylene oxide or propylene oxide unit, m is an integer greater than 0, or between about 0.5 and about 30, and M is a cation, for example sodium, potassium, lithium, calcium, magnesium, ammonium or a substituted ammonium cation. Specific examples of substituted ammonium cations are methyl-, dimethyl-, trimethylammonium and quaternary ammonium cations such as tetramethylammonium and dimethylpiperidinium cations, and also those which are derived from alkylamines such as ethylamine, diethylamine, triethylamine or mixtures thereof. Non-limiting examples include $C_{12}$-$C_{18}$ fatty alcohol ether sulfates where A is an ethylene oxide unit and the content of ethylene oxide units is 1, 2, 2.5, 3 or 4 mol per mole of the fatty alcohol ether sulfate, and in which M is sodium or potassium. A non-limiting fatty alcohol ether sulfate is sodium lauryl ether sulfate with 2 ethylene oxide units. Such a surfactant is for example available under the tradename Texapon® N 70 (BASF, SE).

Non-limiting linear alkylbenzene sulphonates are those having an alkyl chain length of $C_8$-$C_{15}$. In particular, the linear alkylbenzene sulphonate can be a $C_9$-$C_{13}$ alkyl benzene sulphonate, a $C_{10}$-$C_{13}$ alkyl benzene sulphonate or a $C_{10}$-$C_{15}$ alkyl benzene sulphonate.

Further anionic surfactants that may additionally be present in the liquid structured composition are fatty acid soaps. Saturated and unsaturated fatty acid soaps, such as the salts of lauric acid, myristic acid, palmitic acid, stearic acid, (hydrogenated) erucic acid, and behenic acid, are suitable, as are soap mixtures derived in particular from natural fatty acids, e.g. coconut, palm-kernel, olive-oil, or tallow fatty acids. Soaps of $C_{12-18}$ fatty acids may be used.

The amount of fatty acid soap may range from 0.1 to 3% by weight of said composition, such as from 0.2 to 2% by weight of said composition and especially from 0.4 to 1.0% by weight of said composition.

The anionic surfactants, including the fatty acid soaps, can be present in the form of their sodium, potassium, or ammonium salts and as soluble salts of organic bases such as mono-, di-, or triethanolamine. The anionic surfactants are present in the form of their sodium or potassium salts, in particular in the form of the sodium salts.

The liquid detergent composition may further comprise a nonionic surfactant, for example at a level of from 2% up to 10% by weight of the liquid composition, such as 3 to 8 wt.-%.

The nonionic surfactants used are alkoxylated, advantageously ethoxylated, in particular primary alcohols having 8 to 18 carbon atoms and an average of 1 to 12 mol ethylene oxide (EO) per mol of alcohol, in which the alcohol residue can be linear or methyl-branched in the 2-position, or can contain mixed linear and methyl-branched residues, such as those that are usually present in oxo alcohol residues. In a non-limiting embodiment, alcohol ethoxylates may have linear residues made up of alcohols of natural origin having 12 to 18 carbon atoms, e.g. from coconut, palm, tallow, or oleyl alcohol, and an average of 2 to 8 EO per mol of alcohol, for example 7 EO. The degrees of ethoxylation indicated represent statistical averages, which can correspond to an integral or a fractional number for a specific product. Non-limiting alcohol ethoxylates exhibit a restricted distribution of homologs (narrow range ethoxylates, NRE). In addition to these nonionic surfactants, fatty alcohols with more than 12 EO can also be used. Examples of these are tallow fatty alcohol with 14 EO, 25 EO, 30 EO, or 40 EO. Nonionic surfactants that contain EO and PO groups together in the molecule are also usable. Block copolymers having EO-PO block units or PO-EO block units, but also EO-PO-EO copolymers or PO-EO-PO copolymers, can be used in this context. Also usable, of course, are mixed alkoxylated nonionic surfactants in which EO and PO units are distributed statistically rather than in block fashion. Such products are obtainable by the simultaneous action of ethylene oxide and propylene oxide on fatty alcohols. The above described nonionic surfactants are obtainable, for example, under the commercial name Dehydol® (from BASF), for example Dehydol® LT7.

Further types of nonionic surfactants that can be used include alkoxylated fatty acid alkyl esters, surfactants of the amine oxide type, polyhydroxy fatty acid amides or alkylpolyglucosides.

The inventive compositions are aqueous compositions, i.e. comprise water in amounts of more than 20% by weight. In various embodiments the water content can range from about 20 to about 95 wt.-%, such as from about 40 to about 90 wt.-%, alternatively 60 to 90 wt.-%, or from 75 to 85 wt.-%.

The liquid detergent composition can be used to wash and/or clean textile fabrics.

Also encompassed are methods for cleaning of textiles and fabrics using the inventive compositions, for example, in an automated washing process as carried out in an automatic washing machine. During this method, the textiles or fabrics to be cleaned are contacted with the inventive compositions, usually in diluted form (suds).

The liquid detergent composition is manufactured using usual and known methods and processes. For example, the constituents of the liquid composition can be simply mixed in agitator vessels, if present, water, non-aqueous solvent, and surfactants usually being prepared first. Further components, including for example a structurant, are then added in portions. In a final stage, the solid particles are added and evenly distributed within the liquid composition.

The solid particles may be manufactured using a microcapsule slurry, i.e. a suspension of the microcapsules in a liquid medium, usually water and/or organic solvents, which is combined with the polymeric matrix material, with beads being formed from the resulting material by known techniques, such as dropletizing. Suitable techniques and methods are well known in the field and can be routinely carried out by those skilled in the art.

EXAMPLES

Example 1

A perfume microcapsule slurry (melamin-formaldehyde capsules; solid content in the slurry 40% by weight) is mixed at room temperature with a solution of 0.5% sodium alginate in water and added dropwise to a 5% solution of calcium acetate in water. The resulting gel beads are cured for about 5-10 minutes and then isolated by filtration, washed with small amount of water and formulated into a clear liquid detergent base (see below). The obtained gel beads were essentially spherical in shape and had diameters in the range of 1-2 mm.

Liquid detergent base

| Component | Amount (actives in wt. - %) |
|---|---|
| Linear alkyl benzene sulfonate (LAS) | 2.5 to 4.5 |
| FAES | 2.5 to 5.0 |
| Nonionic surfactant | 3.0 to 5.5 |
| Soap | 0.4 to 0.9 |
| Citric acid anhydrous | 0.2 to 0.5 |
| Phosphonate (DTPMP) | 0.15 to 0.5 |
| Structural (cellulose) | 1.0 to 2.0 |
| Enzymes, enzyme stabilizers, preservatives, colorants, fluorescent whitening agent, antifoam | 1.0 to 6.0 |
| Water | Ad 100 |

What is claimed is:

1. A liquid detergent composition comprising:

a continuous liquid phase that is transparent or translucent; and a plurality of polymeric droplets dispersed in the continuous liquid phase; wherein each polymeric droplet has a diameter ranging from about 0.8 to about 8 mm;

wherein each polymeric droplet comprises:

a plurality of microcapsules dispersed in each polymeric droplet; wherein each microcapsule of the plurality of microcapsules has a core-shell morphology; wherein the plurality of microcapsules have a diameter ranging from about 4 to about 70 μm.

2. The liquid detergent composition of claim 1, wherein one or more microcapsules of the plurality of microcapsules encapsulate a benefit agent.

3. The liquid detergent composition of claim 1, wherein the liquid detergent composition is a structured liquid detergent composition.

4. The liquid detergent composition of claim 1, wherein a concentration of the polymeric droplets in the liquid detergent ranges from about 0.05 wt.-% to about 5 wt.-%.

5. The liquid detergent composition of claim 1, wherein a concentration of the microcapsules ranges from about 10 wt.-% to about 70 wt-% relative to the total weight of the polymeric droplets.

6. The liquid detergent composition of claim 1, wherein a material of each polymeric droplet is selected from the group consisting of alginate, carrageen, gelatin, agar agar, gellan, and combinations thereof.

7. The liquid detergent composition of claim 1, wherein the shell of each microcapsule comprises a polymeric material selected from the group consisting of polyacrylates, polyethylene, polyamides, polystyrenes, polyisoprenes, polycarbonates, polyesters, polyureas, polyurethanes, polyolefins, polysaccharides, epoxy resins, vinyl polymers, urea crosslinked with formaldehyde or glutaraldehyde, melamine cross-linked with formaldehyde, gelatin-polyphosphoate coacervates optionally cross-linked with glutaraldehyde, gelatin-gum arabic coacervates, silicone resins, unreacted polyamines with polyisocyanates, acrylate monomers polymerized by means of free radical polymerization, silk, wool, gelatin, cellulose, proteins, blends thereof, and copolymers thereof.

8. The liquid detergent composition of claim 1, further comprising a neat fragrance external to the microcapsules.

9. The liquid detergent composition of claim 1, wherein the liquid phase comprises at least one detersive surfactant and water.

10. A method for the cleaning of textiles, wherein the method comprises:

contacting the textiles with an aqueous solution of the liquid detergent composition of claim 1.

11. The liquid detergent composition of claim 1, wherein the diameter of each polymeric droplet ranges from about 1.0 to 2.5 mm.

12. The liquid detergent composition of claim 2, wherein the benefit agent is a fragrance.

13. The liquid detergent composition of claim 1, wherein the concentration of the polymeric droplets in the liquid detergent ranges from about 0.1 to 0.35 wt.-%.

14. The liquid detergent composition of claim 1, wherein the concentration of the microcapsules ranges from about 15 to about 50 wt.-% relative to the total weight of the polymeric droplets.

15. The liquid detergent composition of claim 7, wherein the polymeric material is selected from the group consisting of polyacrylate, polyurethane, polylactic acid, melamin formaldehyde, polyuria, and combinations thereof.

16. The liquid detergent composition of claim 1, wherein the plurality of microcapsules are entrapped in the polymeric droplets and that the content of free microcapsules in the liquid phase is below 0.1 wt %, based on the total weight of the liquid detergent composition.

17. The liquid detergent composition of claim 1, wherein the composition has a transmission at 20° C. of at least 70% or more in the visible spectrum as compared to a reference sample of deionized water.

18. The liquid detergent composition of claim 17, wherein the composition has a nephelometric turbidity (NTU) of 60 or less.

19. The liquid detergent composition of claim 1, wherein each polymeric droplet comprises from about 200 to about 10,000,000 microcapsules.

20. The liquid detergent composition of claim 1, wherein each polymeric droplet is homogenous with respect to its mass to material distribution.

* * * * *